US005801137A

United States Patent [19]

Addison et al.

[11] Patent Number: 5,801,137

[45] Date of Patent: *Sep. 1, 1998

[54] DETERGENT COMPOSITIONS CONTAINING (POLY)CARBOXYLATES, ORGANO DIPHOSPHONIC AND ACRYLIC ACID DERIVED COMPONENTS, AND SILICATE

[75] Inventors: Michael Crombie Addison; Lynda Anne Jones; Rhona Alexandra Knox, all of Newcastle upon Tyne, England

[73] Assignee: The Procter & Gamble Company, Cincinnati, Ohio

[ * ] Notice: The term of this patent shall not extend beyond the expiration date of Pat. No. 5,591,703.

[21] Appl. No.: 770,840

[22] Filed: Dec. 20, 1996

Related U.S. Application Data

[63] Continuation of Ser. No. 349,770, Dec. 6, 1994, abandoned.

[30] Foreign Application Priority Data

Dec. 23, 1993 [GB] United Kingdom ..... 9326281

[51] Int. Cl.[6] ..... C11D 7/60; C11D 3/36; C11D 3/37; C11D 7/36

[52] U.S. Cl. ..... 510/228; 510/224; 510/226; 510/229; 510/230; 510/469; 510/476; 510/477; 510/478; 510/488; 510/511

[58] Field of Search ..... 510/229, 230, 510/223, 224, 226, 228, 476, 469, 477, 478, 511, 509, 488

[56] References Cited

U.S. PATENT DOCUMENTS

| | | | |
|---|---|---|---|
| 3,965,024 | 6/1976 | Schmadel et al. | 252/95 |
| 4,530,766 | 7/1985 | Hann et al. | 210/701 |
| 4,806,259 | 2/1989 | Amjad | 252/80 |
| 4,992,194 | 2/1991 | Liberati et al. | 252/99 |
| 5,084,535 | 1/1992 | Hennig et al. | 526/211 |
| 5,259,985 | 11/1993 | Nakanishi et al. | 252/180 |
| 5,264,142 | 11/1993 | Hessel et al. | 252/95 |
| 5,281,351 | 1/1994 | Romeo et al. | 252/99 |
| 5,292,446 | 3/1994 | Painter et al. | 252/99 |
| 5,401,311 | 3/1995 | Freese et al. | 134/2 |
| 5,468,411 | 11/1995 | Dixit et al. | 510/226 |
| 5,474,699 | 12/1995 | Ahmed et al. | 252/99 |
| 5,545,346 | 8/1996 | MacBeath et al. | 510/514 |
| 5,545,352 | 8/1996 | Pike | 510/514 |
| 5,591,703 | 1/1997 | Sadlowski | 510/220 |
| 5,597,789 | 1/1997 | Sadlowski | 510/230 |

FOREIGN PATENT DOCUMENTS

| | | | |
|---|---|---|---|
| 0 364 067 | 4/1990 | European Pat. Off. | C11D 3/10 |
| 4332800 | 11/1992 | Japan . | |
| 673 033 A5 | 1/1990 | Switzerland | C11D 3/08 |
| 2227021 | 7/1990 | United Kingdom . | |

OTHER PUBLICATIONS

Chemical Abstract accession No. 118:215376, for JP 4–332800, Nov. 19, 1992.

Derwent Abstract accession No. 93–004727, for JP 4–332800, Nov. 19, 1992.

*Primary Examiner*—Ardith Hertzog

*Attorney, Agent, or Firm*—K. K. Patel; K. W. Zerby; J. C. Rasser

[57] ABSTRACT

A detergent composition containing in combination (a) a detergent builder system containing a carboxylate or polycarboxylate builder and having a major proportion by weight of non-carbonate builder compound;

(b) an organo diphosphonic acid or its salts or complexes or any mixture thereof; and (c) an organic polymer containing acrylic acid or its salts, having an average molecular weight of less than 15,000.

17 Claims, No Drawings

DETERGENT COMPOSITIONS CONTAINING (POLY)CARBOXYLATES, ORGANO DIPHOSPHONIC AND ACRYLIC ACID DERIVED COMPONENTS, AND SILICATE

This is a continuation of application Ser. No. 08/349,770, filed Dec. 6,1994 now abandoned.

TECHNICAL FIELD

The present invention relates to detergent compositions, useful in machine dishwashing, containing in combination, a carboxylate or polycarboxylate builder, an organo diphosphonic acid crystal growth inhibitor and a low molecular weight polymer containing acrylic acid.

BACKGROUND OF THE INVENTION

Detergent compositions designed for use in automatic dishwasher machines are well known, and a consistent effort has been made by detergent manufacturers to improve the cleaning and/or rinsing efficiency of said compositions on dishes and glassware, as reflected by numerous patent publications.

The general problem of the formation of deposits as spots and films on the articles in the wash, and on the dishwasher machine parts is well known in the art.

Whilst the general problem of deposit formation is known, a full understanding of the many facets of the problem is however still an active area of research.

A range of deposit types can be encountered. The redeposition of soils or the breakdown products thereof, which have previously been removed from the soiled tableware in the washload, provides one deposit type. Insoluble salts such as calcium carbonate, calcium fatty acid salts (lime soaps), or certain silicate salts are other common deposit types. Composite deposit types are also common. Indeed, once an initial minor deposit forms it can act as a "seeding centre" for the build up of a larger, possibly composite, deposit structure.

Deposit formation can occur on a range of commonly encountered substrate surfaces including plastic, glass, metal and china surfaces. Certain deposit types however, show a greater propensity to deposit on certain substrates. For example, lime soap deposit formation tends to be a particular problem on plastic substrates, and silicate deposit formation tends to occur on glassware.

The formation of insoluble carbonate, especially calcium carbonate, deposits is a particular problem in the machine dishwashing art. There is a general appreciation in the art, as represented for example by EP-A-364,067 in the name of Clorox, CH-A-673,033 in the name of Cosmina, and EP-A-551,670 in the name of Unilever, that calcium carbonate deposit formation is a particular problem when non-phosphate containing detergent formulations are employed. In general, this can be explained by the slightly inferior builder capacity of the typically employed non-phosphate builder systems in comparison to phosphate builder formulations. The problem of calcium carbonate deposit formation is understood to be especially apparent when these formulations contain a carbonate builder component, as for example is essential to the compositions taught by EP-A-364,067.

The Applicants have now found that the problem of $CaCO_3$ deposit formation can exist even in the absence of a carbonate builder component in the machine dishwashing detergent formulation, and especially when that formulation contains no phosphate builder component. The naturally sourced, inlet water to the dishwasher machine can be a sufficient source of $Ca^{2+}$ and $Mg^{2+}$ ions and $HCO_3^-/CO_3^{2-}$ ions to make deposit formation a problem. Whilst the salt softening system, through which the inlet water will pass prior to entry into the main cavity of the dishwasher machine, can be efficient at removing the naturally present $Ca^{2+}$ and $Mg^{2+}$ ions it is inefficient at removing the $HCO_3^-/CO_3^{2-}$ ions which therefore enter into the wash/rinse solution.

The Applicants have now established that both the levels of $Ca^{2+}/Mg^{2+}$ hardness ions and the levels of $HCO_3^-/CO_3^{2-}$ ions in the wash/rinse water of the dishwasher machine are factors controlling calcium carbonate deposit formation. Critical levels of both components must be exceeded for deposit formation to occur. These critical levels are to an extent interdependent. Thus, even in wash solutions containing high levels of one component deposit formation will not occur in the absence of the critical level of the other component.

A relatively high level of $Ca^{2+}$ ions in the wash solution can be desirable for the effective performance of certain enzyme components of the detergent formulation, particularly lipolytic and proteolytic enzymes. Such higher levels of $Ca^{2+}$ tend to be present when non-phosphate built formulations are employed. Whilst these relatively high levels of $Ca^{2+}$ are desirable for enzyme performance, calcium carbonate deposition will tend to occur if the solution contains a level of carbonate ion above the critical limit for deposit formation.

The Applicants have also established that the formation of deposit "seeding centres", which in turn enable the build up of more substantial deposits, occurs most commonly in the rinse cycle of the dishwasher machine. Deposit build up is most apparent on the heater element of the dishwasher machine. It has also been established that the problem is most apparent when more alkaline formulations, such as those of pH of 9.8 and above, are employed. An upper limit to the pH of about 11.5 has been found to be preferred for the effective working of other preferred components of the composition such as peroxyacid bleaches and enzymes.

The Applicants have found that the problem of calcium carbonate deposit formation may be effectively ameliorated by the inclusion of an organo diphosphonic acid component in combination with an acrylic acid containing polymer having a molecular weight of less than 15,000 into the detergent formulation.

Acrylic acid containing organic polymers of higher molecular weight, such as the commonly used maleic/acrylic acid copolymers of molecular weight from typically 40,000 to 80,000, did not provide equivalent deposit formation prevention capability. Indeed, the formation of the insoluble calcium salts of such higher molecular weight polymers was noted potentially to lead to a worsening of the deposition profile of the compositions in use.

When the combination of said diphosphonic acid and polymer components is employed in a non-phosphate built formulation the occurrence of calcium carbonate deposits is essentially comparable to that obtained for a more highly built, phosphate containing formulation which does not contain these components.

The Applicants have also found that carboxylates and polycarboxylates, particularly citrates, are especially useful components of the compositions of the invention because of their magnesium binding capacity which tends to prevent the formation of insoluble magnesium salts, such as magnesium silicate on the articles in the wash. Such polycarboxylates also provide calcium binding capacity to the compositions, thus contributing further to the prevention of the formation of calcium salt deposits.

The Applicants have also found that the more effective control of calcium carbonate deposition can also lead to benefits in the prevention of the formation of other deposit types, particularly lime soap deposits and silicate deposits.

Lime soap deposits are most commonly encountered when the washload contains fatty soils, which naturally contain levels of free fatty acids, and when lipolytic enzymes are components of the formulation. Lipolytic enzymes catalyse the degradation of fatty soils into free fatty acids and glycerol. Silicate is a common component of machine dishwashing formulations, where it is added for its china and glass care capability. It is the Applicant's finding that by preventing the formation of calcium carbonate deposit "seeding centres", most particularly in the rinse cycle, the build up of other deposit types from these "seeding centres" is also prevented.

GB-A-2,203,163 discloses aqueous liquid detergent compositions for use in mechanical dishwashers containing a polyacrylic acid and/or a polyhydroxy acrylic acid and a chlroine resistant phosphonate or organic phosphate, sodium hydroxide and sources of alkalinity to provide a composition pH of 13. No disclosure is provided of the essential carboxylate or polycarboxylate component of the present inventions.

U.S. Pat. No. 4,846,993 discloses zero phosphate warewashing detergent compositions containing a source of alkalinity, a water-conditioning vinyl polymer with pendant—$CO_2H$ groups, a soil-dispersing phosphinopolycarboxylic acid, and a water-conditioning organic phosphonate. The requirement for a polycarboxylate builder component is not taught by this document. Furthermore, the compositions of the present invention preferably do not contain the phosphinopolycarboxylic acid component taught therein.

U.S. Pat. No. 4,919,845 discloses compositions which may contain HEDP and a copolymer of (meth)acrylic acid and maleic acid. Said copolymer may have a molecular weight of from 2000 to 200,000 but is preferably from 50,000 to 120,000. Such preferred higher molecular weight copolymers lie outside of the ambit of the present invention. Indeed, as has been previously noted, their presence may lead to a worsening of the calcium salt deposit profile in direct contrast to the object of the present invention.

WO 92/13061 discloses solid cast silicate-based cleaning compositions which may contain a polyacrylate and a phosphonate, which components are stated to cooperate to form a threshold system which is effective for controlling precipitation of calcium and magnesium in a use solution. The necessity of a carboxylate or polycarboxylate builder is not taught by this reference.

SUMMARY OF THE INVENTION

There is provided a detergent composition containing builder in combination (a) a detergent builder system containing a carboxylate or polycarboxylate builder containing from one to four carboxy groups, wherein said detergent builder system has a major proportion by weight of non-carbonate builder compound;

(b) an organo diphosphonic acid or its salts or complexes or any mixture thereof; and (c) an organic polymer containing acrylic acid or its salts, having an average molecular weight of less than 15,000.

DETAILED DESCRIPTION OF THE INVENTION

Organo Diphosphonic Acid Crystal Growth Inhibitor

An essential component of the detergent compositions in accordance with the invention is an organo diphosphonic acid or one of its salts/complexes. The organo diphosphonic acid component is preferably present at a level of from 0.005% to 20%, more preferably from 0.1% to 10%, most preferably from 0.2% to 5% by weight of the compositions.

By organo diphosphonic acid it is meant herein an organo diphosphonic acid which does not contain nitrogen as part of its chemical structure. This definition therefore excludes the organo aminophosphonates, which however may be included in compositions of the invention as heavy metal ion sequestrants.

The organo diphosphonic acid component may be present in its acid form or in the form of one of its salts or complexes with a suitable counter cation and reference hereinafter to the acid implicitly includes reference to said salts or complexes. Preferably any salts/complexes are water soluble, with the alkali metal and alkaline earth metal salts/complexes being especially preferred.

The organo diphosphonic acid is preferably a $C_1$–$C_4$ diphosphonic acid, more preferably a $C_2$ diphosphonic acid, such as ethylene diphosphonic acid, or most preferably ethane 1-hydroxy-1, 1-diphosphonic acid (HEDP).

Low Molecular Weight Acrylic Acid Containing Organic Polymer

A second essential component of the detergent compositions in accord with the invention is an organic polymer containing acrylic acid or its salts having an average molecular weight of less than 15,000, hereinafter referred to as low molecular weight acrylic acid containing polymer.

The low molecular weight acrylic acid containing polymer has an average molecular weight of less than 15,000, preferably from 500 to 12,000, more preferably from 1,500 to 10,000, most preferably from 2,500 to 9,000.

The low molecular weight acrylic acid containing organic polymer is preferably present at a level of from 0.0050% to 20%, more preferably from 0.1% to 10%, most preferably from 0.2% to 8% by weight of the compositions.

The weight ratio of low molecular weight acrylic acid containing polymer to organo diphosphonic acid component is preferably from 50:1 to 1:5, more preferably from 20:1 to 1:1, most preferably from 15:1 to 2:1.

In a preferred aspect, the low molecular weight acrylic acid containing polymer and organo diphosphic acid components are present in the compositions in intimate admixture, most especially in the form of a particle comprising said two components which itself forms part of a granular composition.

The low molecular weight acrylic acid containing polymer may be either a homopolymer or a copolymer including the essential acrylic acid or acrylic acid salt monomer units. Copolymers may include essentially any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof.

Preferred commercially available low molecular weight acrylic acid containing homopolymers include those sold under the tradename Sokalan PA30, PA20, PA15 and PA10 by BASF GmbH, and those sold under the tradename Acusol 45N by Rohm and Haas.

Preferred low molecular weight acrylic acid containing copolymers include those which contain as monomer units: a) from 90% to 10%, preferably from 80% to 20% by weight acrylic acid or its salts and b) from 10% to 90%, preferably from 20% to 80% by weight of a substituted acrylic monomer or its salts having the general formula $—CHR_2=CR_1(CO—O—R_3)$ wherein at least one of the substituents $R_1$, $R_2$ or $R_3$, preferably $R_1$, or $R_2$ is a 1 to 4 carbon alkyl or hydroxyalkyl group, $R_1$, or $R_2$ can be a hydrogen and $R_3$ can be a hydrogen or alkali metal salt. Most preferred is a substituted acrylic monomer wherein $R_1$ is methyl, $R_2$ is hydrogen (i.e. a methyl acrylic acid monomer). The most preferred copolymer of this type has a molecular weight of 3500 and contains 60% to 80% by weight of acrylic acid and 40% to 20% by weight of methyl acrylic acid.

Preferred commercially available low molecular weight acrylic acid containing copolymers include those sold under the tradename Sokalan CP10 by BASF GmbH.

Other suitable polyacrylate/modified polyacrylate copolymers include those copolymers of unsaturated aliphatic carboxylic acids disclosed in U.S. Pat. Nos. 4,530,766, and 5,084,535 which have a molecular weight of less than 15,000 in accordance with the invention.

Additional Organic Polymeric Compound

Certain additional organic polymeric compounds may be added to the detergent compositions of the invention, however, in certain cases their presence is desirably minimized. By additional organic polymeric compounds it is meant essentially any polymeric organic compounds commonly used as dispersants, anti-redeposition and soil suspension agents in detergent compositions, which do not fall within the definition of low molecular weight acrylic acid containing polymers given hereinbefore.

Additional organic polymeric compound may be incorporated into the detergent compositions of the invention at a level of from 0.05% to 30%, preferably from 0.5% to 15%, most preferably from 1% to 10% by weight of the compositions.

Examples of additional organic polymeric compounds whose presence is desirably minimized, and which are preferably not present, include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are the copolymers of polyacrylate with maleic anhydride having a molecular weight of from 20,000 to 150,000, especially about 40,000 to 80,000.

The polyamino compounds are useful herein including those derived from aspartic acid such as those disclosed in EP-A-305282, EP-A-305283 and EP-A-351629.

Other additional organic polymeric compounds suitable for incorporation in the detergent compositions herein include cellulose derivatives such as methylcellulose, carboxymethylcellulose and hydroxyethylcellulose.

Further useful additional organic polymeric compounds are the polyethylene glycols, particularly those of molecular weight 1000–10000, more particularly 2000 to 8000 and most preferably about 4000.

Detergent Builder System

An essential component of the detergent compositions of the present invention is a detergent builder system containing a major proportion of non-carbonate builder compound, wherein said detergent builder system is preferably present at a level of from 0.5% to 80% by weight, more preferably from 1% to 60% by weight, most preferably from 2% to 40% weight of the compositions.

The builder system contains at most a minor proportion by weight of carbonate builder compound, more preferably less than 30% by weight of the builder system is carbonate builder compound. Most preferably none of the builder system is carbonate builder compound.

The detergent builder system is preferably water-soluble, and contains a carboxylate or polycarboxylate builder containing from one to four carboxy groups, particularly selected from monomeric polycarboxylates or their acid forms, homo or copolymeric polycarboxylic acids or their salts in which the polycarboxylic acid comprises at least two carboxylic radicals separated from each other by not more that two carbon atoms.

The detergent builder system can additionally contain alkali metal, ammonium or alkanonammonium salts of bicarbonates, borates, phosphates, and mixtures of any of the foregoing.

Preferably, the detergent builder system contains no phosphate builder compound.

Carboxylate or Polycarboxylate Builder

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The carboxylate or polycarboxylate builder can be momomeric or oligomeric in type although monomeric polycarboxylates are generally preferred for reasons of cost and performance. Monomeric and oligomeric builders can be selected from acyclic, alicyclic, heterocyclic and aromatic carboxylates.

Suitable carboxylates containing one carboxy group include the water soluble salts of lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates, especially sodium citrate.

The parent acids of the monomeric or oligomeric polycarboxylate chelating agents or mixtures thereof with their salts, e.g. citric acid or citrate/citric acid mixtures are also contemplated as components of builder systems of the detergent compositions in accordance with the present invention.

Carbonate Builder Compound

Specific examples of carbonate builder compound include the alkali metal carbonates, bicarbonates and sesquicarbonates. Carbonate builder compound may be present only as a minor component of the builder system.

Additional Builder Compound

Specific examples of phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid. Preferably, no phosphate builder compound is present.

The detergent compositions of the invention may also include less water soluble builders although preferably their levels of incorporation are minimized. Examples of such less water soluble builders include the crystalline layered silicates, and the largely water insoluble sodium aluminosilicates.

Alkalinity

An alkalinity source is a preferred component of the compositions of the invention. A useful alkalinity source is provided by silicates which also provide china care properties to the detergent formulation. Suitable silicates include the water soluble sodium silicates with an $SiO_2$:$Na_2O$ ratio of from 1.0 to 2.8, with ratios of from 1.6 to 2.4 being preferred, and 2.0 ratio being most preferred. The silicates may be in the form of either the anhydrous salt or a hydrated salt. Sodium silicate with an $SiO_2$:$Na_2O$ ratio of 2.0 is the most preferred silicate.

Silicates are preferably incorporated in the compositions of the invention at a level of from 1% to 50%, preferably from 5% to 40%, most preferably from 5% to 30% by weight.

Surfactant System

A highly preferred component of the detergent compositions of the invention is a surfactant system comprising surfactant selected from anionic, cationic, nonionic ampholytic and zwitterionic surfactants and mixtures thereof. The surfactant system is typically present at a level of from 0.50to 40% by weight, more preferably 1% to 306 by weight, most preferably from 1.5% to 20% by weight of the compositions.

In one preferred execution of the invention the surfactant system consists of low foaming nonionic surfactant, preferably selected from ethoxylated and/or propoxylated nonionic surfactants, more preferably selected from nonionic ethoxylated/propoxylated fatty alcohol surfactants.

In an alternative preferred execution of the invention the surfactant system comprises high foaming anionic surfactant, particularly alkyl ethoxysulfate surfactant, in combination with a suds suppressing system.

Anionic Surfactant

Essentially any anionic surfactants useful for detersive purposes can be included in the compositions. These can include salts (including, for example, sodium, potassium, ammonium, and substituted ammonium salts such as mono-, di-and triethanolamine salts) of the anionic sulfate, sulfonate, carboxylate and sarcosinate surfactants.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary alkyl sulfates, alkyl ethoxysulfates, fatty oleyl glycerol sulfates, alkyl phenol ethylene oxide ether sulfates, the $C_5$–$C_{17}$ acyl-N-($C_1$–$C_4$ alkyl) and —N-($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl ethoxysulfate surfactants are preferably selected from the group consisting of the $C_6$–$C_{18}$ alkyl sulfates which have been ethoxylated with from about 0.5 to about 20 moles of ethylene oxide per molecule, more preferably, the alkyl ethoxysulfate surfactant is a $C_6$–$C_{18}$ alkyl sulfate which has been ethoxylated with from about 0.5 to about 20, preferably from about 0.5 to about 5, moles of ethylene oxide per molecule.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Anionic carboxylate surfactants suitable for use herein include the alkyl ethoxy carboxylates, the alkyl polyethoxy polycarboxylate surfactants and the soaps ('alkyl carboxyls'), especially certain secondary soaps as described herein.

Preferred alkyl ethoxy carboxylates for use herein include those with the formula $RO(CH_2CH_2O)_x$ $CH_2COO^-M^+$ wherein R is a $C_6$ to $C_{18}$ alkyl group, x ranges from 0 to 10, and the ethoxylate distribution is such that, on a weight basis, the amount of material where x is 0 is less than about 20%, and the amount of material where x is greater than 7, is less than about 25%, the average x is from about 2 to 4 when the average R is $C_{13}$ or less, and the average x is from about 3 to 10 when the average R is greater than $C_{13}$, and M is a cation, preferably chosen from alkali metal, alkaline earth metal, ammonium, mono-, di-, and tri-ethanolammonium, most preferably from sodium, potassium, ammonium and mixtures thereof with magnesium ions. The preferred alkyl ethoxy carboxylates are those where R is a $C_{12}$ to $C_{18}$ alkyl group.

Alkyl polyethoxy polycarboxylate surfactants suitable for use herein include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Preferred soap surfactants are secondary soap surfactants which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants should preferably contain no ether linkages, no ester linkages and no hydroxyl groups. There should preferably be no nitrogen atoms in the head-group (amphiphilic portion). The secondary soap surfactants usually contain 11–13 total carbon atoms, although slightly more (e.g., up to 16) can be tolerated, e.g. p-octyl benzoic acid.

The following general structures further illustrate some of the preferred secondary soap surfactants:

A. A highly preferred class of secondary soaps comprises the secondary carboxyl materials of the formula $R^3$ $CH(R^4)$ COOM, wherein $R^3$ is $CH_3(CH_2)x$ and $R^4$ is $CH_3(CH_2)y$, wherein y can be O or an integer from 1 to 4, x is an integer from 4 to 10 and the sum of (x+y) is 6–10, preferably 7–9, most preferably 8.

B. Another preferred class of secondary soaps comprises those carboxyl compounds wherein the carboxyl substituent is on a ring hydrocarbyl unit, i.e., secondary soaps of the formula $R^5$–$R^6$—COOM, wherein $R^5$ is $C^7$–$C^{10}$, preferably $C^8$–$C^9$, alkyl or alkenyl and $R^6$ is a ring structure, such as benzene, cyclopentane and cyclohexane. (Note: $R^5$ can be in the ortho, meta or para position relative to the carboxyl on the ring.)

C. Still another preferred class of secondary soaps comprises secondary carboxyl compounds of the formula $$CH_3(CHR)_k—(CH_2)_m—(CHR)_n—CH(COOM)(CHR)_o(CH2)_p(CHR)_q—CH_3,$$

wherein each R is $C_1$–$C_4$ alkyl, wherein k, n, o, q are integers in the range of 0–8, provided that the total number of carbon atoms (including the carboxylate) is in the range of 10 to 18.

In each of the above formulas A, B and C, the species M can be any suitable, especially water-solubilizing, counterion.

Especially preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid.

Alkali Metal Sarcosinate Surfactant

Other suitable anionic surfactants are the alkali metal sarcosinates of formula R—CON ($R^1$) $CH_2$ COOM, wherein R is a $C_5$–$C_{25}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Nonionic Surfactant

Essentially any anionic surfactants useful for detersive purposes can be included in the compositions. Exemplary, non-limiting classes of useful nonionic surfactants are listed below.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11-C17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Condensates of Alkyl Phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide.

Nonionic Ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol.

Nonionic Ethoxylated/Propoxylated Fatty Alcohol Surfactant

The ethoxylated $C_6$–$C_{18}$ fatty alcohols and $C_6$–$C_{18}$ mixed ethoxylated/propoxylated fatty alcohols are preferred surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. Examples of compounds of this type include certain of the commercially-available PluronicTM surfactants, marketed by BASF.

Nonionic EO Condensation Products with Propylene Oxide/Ethylene Diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. Examples of this type of nonionic surfactant include certain of the commercially available Tetronic™ compounds, marketed by BASF.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units.

The preferred alkylpolyglycosides have the formula $$R^2O(C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose.

Nonionic Fatty Acid Amide Surfactant

Fatty acid amide surfactants suitable for use herein are those having the formula:

$$R^6-\overset{\overset{\displaystyle O}{\|}}{C}-N(R^7)2$$

wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Amphoteric Surfactant

Suitable amphoteric surfactants for use herein include the amine oxide surfactants and the alkyl amphocarboxylic acids.

A suitable example of an alkyl aphodicarboxylic acid for use herein is Miranol(TM) C2M Conc. manufactured by Miranol, Inc., Dayton, N.J.

Amine Oxide Surfactant

Amine oxides useful in the present invention include those compounds having the formula $$R^3(OR^4)_xN(R^5)_2 \rightarrow O$$

wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{18}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$–$C_{18}$ alkyl dimethylamine oxide, and $C_{10}l$-$_8$ acylamido alkyl dimethylamine oxide.

Zwitterionic Surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Betaine Surfactant

The betaines useful herein are those compounds having the formula $R(R')_2N^+R^2COO^-$ wherein R is a $C_6$–$C_{18}$ hydrocarbyl group, preferably a $C_{10}$–$C_{16}$ alkyl group or $C_{10-16}$ acylamido alkyl group, each $R^1$ is typically $C_1$–$C_3$ alkyl, preferably methyl,m and $R^2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethyl-betaine; [$C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Sultaine Surfactant

The sultaines useful herein are those compounds having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group.

Ampholytic Surfactant

Ampholytic surfactants can be incorporated into the detergent compositions herein. These surfactants can be broadly described as aliphatic derivatives of secondary or tertiary amines, or aliphatic derivatives of heterocyclic secondary and tertiary amines in which the aliphatic radical can be straight chain or branched.

Cationic Surfactants

Cationic surfactants can also be used in the detergent compositions herein. Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Lime Soap Dispersant Compound

The compositions of the invention may contain a lime soap dispersant compound, which has a lime soap dispersing power (LSDP), as defined hereinafter of no more than 8, preferably no more than 7, most preferably no more than 6. The lime soap dispersant compound is preferably present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. A numerical measure of the effectiveness of a lime soap dispersant is given by the lime soap dispersing power (LSDP) which is determined using the lime soap dispersion test as described in an article by H. C. Borghetty and C. A. Bergman, J. Am. Oil. Chem. Soc., volume 27, pages 88–90, (1950). This lime soap dispersion test method is widely used by practitioners in this art field being referred to , for example, in the following review articles; W. N. Linfield, Surfactant Science Series, Volume 7, p3; W. N. Linfield, Tenside Surf. Det., Volume 27, pages159–161, (1990); and M. K. Nagarajan, W. F. Masler, Cosmetics and Toiletries, Volume 104, pages 71–73, (1989). The LSDP is the % weight ratio of dispersing agent to sodium oleate required to disperse the lime soap deposits formed by 0.025 g of sodium oleate in 30 ml of water of 333 ppm $CaCO_3$ (Ca:Mg=3:2) equivalent hardness.

Polymeric lime soap dispersants suitable for use herein are described in the article by M. K. Nagarajan and W. F. Masler, to be found in Cosmetics and Toiletries, Volume 104, pages 71–73, (1989). Examples of such polymeric lime soap dispersants include certain water-soluble salts of copolymers of acrylic acid, methacrylic acid or mixtures thereof, and an acrylamide or substituted acrylamide, where such polymers typically have a molecular weight of from 5,000 to 20,000.

Surfactants having good lime soap dispersant capability will include certain amine oxides, betaines, sulfobetaines, alkyl ethoxysulfates and ethoxylated alcohols.

Exemplary surfactants having a LSDP of no more than 8 for use in accord with the invention include $C_{16}$–$C_{18}$ dimethyl amine oxide, $C_{12}$–$C_{18}$ alkyl ethoxysulfates with an average degree of ethoxylation of from 1–5, particularly $C_{12}$–$C_{15}$ alkyl ethoxysulfate surfactant with a degree of ethoxylation of about 3 (LSDP=4), and the $C_{13}$–$C_{15}$ ethoxylated alcohols with an average degree of ethoxylation of either 12 (LSDP=6) or 30, sold under the trade names Lutensol A012 and Lutensol A030 respectively, by BASF GmbH.

Bleaching Agents

The detergent compositions of the invention may include bleaching agent selected from chlorine bleaches, inorganic perhydrate salts, peroxyacid bleach precursors and organic peryoxacids.

In a particularly preferred embodiment of the invention, there is provided a means of delaying the release of oxygen bleach into the wash solution. Said means may be provided, for example by coating a granular bleach component with a hydrophobic coating, or by choice of physical form of the bleach which has a slow rate of dissolution by virtue, for example of its density or particle size.

Delayed release of bleach into the wash solution can be advantageous in the prevention of tarnishing of silverware in washload, particularly when a component designed to protectively coat the silver in the wash is also included in the formulation. Such silver tarnish prevention technologies are disclosed in the Applicant's co-pending European Applications Nos. 9370004.4, 93870090.3, 93201918.5 and 93202095.1.

Chlorine Bleaching Agents

Chlorine bleaches include the alkali metal hypochlorites and chlorinated cyanuric acid salts. The use of chlorine bleaches in the composition of the invention is preferably minimized, and more preferably the compositions contain no chlorine bleach.

Inorganic Perhydrate Bleaching Agents

The detergent compositions in accord with the invention preferably include an inorganic perhydrate salt, normally in the form of the sodium salt preferably at a level of from 1% to 40% by weight, more preferably from 2% to 30% by weight and most preferably from 5% to 25% by weight of the compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Sodium percarbonate, which is a preferred perhydrate for inclusion in detergent compositions in accordance with the invention, is an addition compound having a formula corresponding to $2Na_2CO_3.3H_2O_2$, and is available commercially as a crystalline solid. The percarbonate is most preferably incorporated into such compositions in coated form. The most preferred coating material comprises mixed salt of an alkali metal sulphate and carbonate. Such coatings together with coating processes have previously been described in GB-1,466,799, granted to Interox on 9th Mar. 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is form 0.1 to 3, preferably n is from 0.15 to 1.0 and most preferably n is from 0.2 to 0.5.

Another suitable coating material is sodium silicate of $SiO_2$:$Na_2O$ ratio from 1.6:1 to 3.4:1, preferably 2.8:1, applied as an aqueous solution to give a level of from 2% to 10%, (normally from 3% to 5%) of silicate solids by weight of the percarbonate. Magnesium silicate can also be included in the coating. Other suitable coating materials include the alkali and alkaline earth metal sulphates and carbonates.

Potassium peroxymonopersulfate is another inorganic perhydrate salt of usefulness in the detergent compositions.

Peroxyacid Bleach Precursors

The detergent compositions in accord with the present invention also preferably include a peroxyacid bleach precursor (bleach activator), usually in combination with an inorganic perhydrate salt. Peroxyacid bleach precursors are normally incorporated at a level of from 1 to 20% by weight, more preferably from 1% to 10% by weight, most preferably from 1% to 7% by weight of the compositions.

Peroxyacid bleach precursors for inclusion in the machine dishwashing detergent compositions in accordance with the invention typically contain one or more N- or O- acyl groups, which precursors can be selected from a wide range of classes. Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864798, 1147871 and 2143231 and imides such as are disclosed in GB-A-855735 & 1246338.

Particularly preferred bleach precursor compounds are the N,N,N',N' tetra acetylated compounds of formula $(CH_3CO)_2$—$(CH_2)_x$—$(CH_3CO)_2$ wherein x can be o or an integer between 1 & 6.

Examples include tetra acetyl methylene diamine (TAMD) in which x=1, tetra acetyl ethylene diamine (TAED) in which x=2 and tetraacetyl hexylene diamine (TAHD) in which x=6.

These and analogous compounds are described in GB-A-907356. The most preferred peroxyacid bleach precursor is TAED.

Another preferred class of peroxyacid bleach activator compounds are the amide substituted compounds described in EP-A-0170386.

Other peroxyacid bleach precursor compounds include sodium nonanoyloxy benzene sulfonate, sodium trimethyl hexanoyloxy benzene sulfonate and sodium acetoxy benzene sulfonate.

Organic Peroxyacids

The detergent compositions may also contain organic peroxyacids at a level of from 1% to 15% by weight, more preferably from 1% to 10% by weight of the composition.

Useful organic peroxyacids include the amide substituted peroxyacids described in EP-A-0170386.

Other organic peroxyacids include diperoxy dodecanedioc acid, diperoxy tetra decanedioc acid, diperoxyhexadecanedioc acid, mono- and diperazelaic acid, mono- and diperbrassylic acid, monoperoxy phthalic acid, perbenzoic acid, and their salts as disclosed in, for example, EP-A-0341 947.

Heavy Metal Ion Sequestrants

Heavy metal ion sequestrants are useful components herein. By heavy metal ion sequestrants it is meant components which act to sequester (chelate) heavy metal ions. These components may also have calcium and magnesium chelation capacity, but preferentially they bind heavy metal ions such as iron, manganese and copper.

Heavy metal ion sequestrants are preferably present at a level of from 0.005% to 20%, more preferably from 0.05% to 10%, most preferably from 0.1% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include the organo aminophosphonates, such as the amino alkylene poly (alkylene phosphonates) and nitrilo trimethylene phosphonates. Preferred organo aminophosphonates are diethylene triamine penta (methylene phosphonate) and hexamethylene diamine tetra (methylene phosphonate).

Other suitable heavy metal ion sequestrants for use herein include nitrilotriacetic acid and polyaminocarboxylic acids such as ethylenediaminotetracetic acid, ethylenetriamine pentacetic acid, or ethylenediamine disuccinic acid. Especially preferred is ethylenediamine-N,N'-disuccinic acid (EDDS), most preferably present in the form of its S,S isomer, which is preferred for its biodegradability profile.

Still other suitable heavy metal ion sequestrants for use herein are iminodiacetic acid derivatives such as 2-hydroxyethyl diacetic acid or glyceryl imino diacetic acid, described in EPA 317 542 and EPA 399 133.

In one preferred aspect of the invention any heavy metal ion sequestrant, particularly where said sequestrant comprises organo aminophosphonate components, is sprayed onto powdered sodium sulphate prior to incorporation into granular compostions in accord with the invention. This step leads to enhanced sequestrant stability in the granular detergent matrix.

Enzyme

Another optional ingredient useful in the detergent compositions of the invention is one or more enzymes.

Preferred enzymatic materials include the commercially available lipases, amylases, neutral and alkaline proteases, esterases, cellulases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Durazym, and Esperase by Novo Industries A/S (Denmark), those sold under the tradename Maxatase, Maxacal and Maxapem by Gist-Brocades, those sold under the tradename FN, FNA and FN-2 by Genencor International, and those sold under the tradename Opticlean and Optimase by Solvay Enzymes. Protease enzyme may be incorporated into the compositions in accordance with the invention at a level of from 0.0001% to 2% active enzyme by weight of the composition. Preferred amylases include, for example, α-amylases obtained from a special strain of B licheniforms, described in more detail in GB-1,269,839 (Novo). Preferred commercially available amylases include for example, those sold under the tradename Rapidase by Gist-Brocades, and those sold under the tradename Termamyl and BAN by Novo Industries A/S. Amylase enzyme may be incorporated into the composition in accordance with the invention at a level of from 0.0001% to 2% active enzyme by weight of the composition.

Lipolytic enzyme (lipase) may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp. or Thermomyces sp. or *Pseudomonas pseudoalcaligenes* or *Pseudomas fluorescens*. Lipase from chemically or genetically modified mutants of these strains are also useful herein.

A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. 4,810,414, Huge-Jensen et al, issued Mar. 7, 1989.

Enzyme Stabilizing System

Enzyme-containing compositions herein may comprise from 0.001i to 10, preferably from 0.005% to 8%,most preferably from 0.01% to 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof. Such stabilizing systems can also comprise reversible protease inhibitors.

The compositions herein may further comprise from 0% to 10%, preferably from 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from 0.5 ppm to 1.75 ppm, the available chlorine in the total volume of water that comes in contact with the enzyme during washing is usually large; accordingly, enzyme stability in-use can be problematic.

Suitable chlorine scavenger anions are widely available, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired.

Corrosion Inhibitor

The present compositions may also contain corrosion inhibitor which is preferably incorporated at a level of from 0.05% to 10%, preferably from 0.1% to 5% by weight of the total composition.

Suitable corrosion inhibitors include paraffin oil typically a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionapthol, thionalide and thioanthranol. Also suitable are the $C_{12}$–$C_{20}$ fatty acids, or their salts, especially aluminium tristearate. The $C_{12}$–$C_{20}$ hydroxy fatty acids, or their salts, are also suitable. Phosphonated octa-decane and other anti-oxidants such as betahydroxytoluene (BHT) are also suitable.

Suds Suppressing System

The compositions of the invention may comprise a suds suppressing system preferably present at a level of from 0.01% to 15%, more preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl alcanol antifoam compounds, and paraffin antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight hydrocarbons such as paraffin, fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters. The hydrocarbons, such as paraffin and haloparaffin, can be utilized in liquid form. The liquid hydrocarbons will be liquid at room temperature and atmospheric pressure, and will have a pour point in the range of about −40° C. and about 5° C., and a minimum boiling point not less than 110° C. (atmospheric pressure). It is also known to utilize waxy hydrocarbons, preferably having a melting point below about 100° C. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms.

Copolymers of ethylene oxide and propylene oxide, particularly the mixed ethoxylated/propoxylated fatty alcohols with an alkyl chain length of from 10 to 16 carbon atoms, a degree of ethoxylation of from 3 to 30 and a degree of propoxylation of from 1 to 10, are also suitable antifoam compounds for use herein.

Suitable 2-alky-alcanols antifoam compounds for use herein have been described in DE 40 21 265. The 2-alkyl-alcanols suitable for use herein consist of a $C_6$ to $C_{16}$ alkyl chain carrying a terminal hydroxy group, and said alkyl chain is substituted in the alpha position by a $C_1$ to $C_{10}$ alkyl chain. Mixtures of 2-alkyl-alcanols can be used in the compositions according to the present invention.

Solvent

The compositions of the invention may contain organic solvents, particularly when formulated as liquids or gels.

The compositions in accord with the invention preferably contain a solvent system present at levels of from 1% to 30% by weight, preferably from 3% to 25% by weight, more preferably form 5% to 20% by weight of the composition. The solvent system may be a mono, or mixed solvent system. Preferably, at least the major component of the solvent system is of low volatility.

Suitable organic solvent for use herein has the general formula $RO(CH_2C(Me)HO)_nH$, wherein R is an alkyl, alkenyl, or alkyl aryl group having from 1 to 8 carbon atoms, and n is an integer from 1 to 4. Preferably, R is an alkyl group containing 1 to 4 carbon atoms, and n is 1 or 2. Especially preferred R groups are n-butyl or isobutyl. Preferred solvents of this type are 1-n-butoxypropane-2-ol (n=l); and 1(2-n-butoxy-l-methylethoxy)propane-2-ol (n=2), and mixtures thereof.

Other solvents useful herein include the water soluble CARBITOL solvents or water-soluble CELLOSOLVE solvents. Water-soluble CARBITOL solvents are compounds of the 2-(2-alkoxyethoxy) ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE solvents are compounds of the 2-alkoxyethoxy ethanol class, with 2-butoxyethoxyethanol being preffered.

Other suitable solvents are benzyl alcohol, and diols such as 2-ethyl-1,3-hexanediol and 2,2,4-trimethl-1,3-pentanediol.

The low molecular weight, water-soluble, liquid polyethylene glycols are also suitable solvents for use herein.

The alkane mono and diols, especially the $C_1$–$C_6$ alkane mono and diols are suitable for use herein. $C_1$–$C_4$ monohydric alcohols (eg: ethanol, propanol, isopropanol, butanol and mixtures thereof) are preferred, with ethanol particularly preferred. The C1–C4 dihydric alcohols, including propylene glycol, are also preferred.

Hydrotropes

Hydrotrope may be added to the compositions in accord with the present invention, and is typically present at levels of from 0.5% to 20%, preferably from 1% to 10%, by weight.

Useful hydrotropes include sodium, potassium, and ammonium xylene sulfonates, sodium, potassium, and ammonium toluene sulfonate, sodium potassium and ammonium cumene sulfonate, and mixtures thereof.

Other Optional Ingredients

Other optional ingredients suitable for inclusion in the compositions of the invention include perfumes, colours and fillers.

pH of the Compositions

The compositions preferably have a pH as a 1% solution in distilled water at 20° C. of from 9.8 to 11.5, preferably from 9.9 to 11.2, most preferably from 10.0 to 11.0.

The pH of the compositions may he adjusted by the use of various pH adjusting agents. Preferred acidification agents include inorganic and organic acids including, for example, carboxylate acids, such as citric and succinic acids. Bicarbonates, particularly sodium bicarbonate, are useful pH adjusting agents herein. A highly preferred acidification acid is citric acid which has the advantage of providing builder capacity to the wash solution.

Form of the Compositions

The detergent compositions of the invention can be formulated in any desirable form such as powders, tablets, granulates, pastes, liquids and gels. Preferably, the compositions are in solid form. Most preferably the low molecular weight acrylic acid containing polymer and organo diphosphonic acid components are present in intimate admixture in such solid compositions.

Liquid Compositions

The detergent compositions of the present invention may be formulated as liquid compositions which typically comprise from 94% to 35% by weight, preferably from 90% to 40% by weight, most preferably from 80% to 50% by weight of a liquid carrier, e.g., water, preferably a mixture of water and organic solvent.

Gel Compositions

Gel compositions are typically formulated with polyakenyl polyether having a molecular weight of from about 750,000 to about 4,000,000.

Solid Compositions

The detergent compositions of the invention may also be in the form of solids, such as powders, granules and tablets.

The particle size of the components of granular compositions in accordance with the invention should preferably be such that no more that 5% of particles are greater than 1.4 mm in diameter and not more than 5% of particles are less than 0.15 mm in diameter.

The bulk density of granular detergent compositions in accordance with the present invention typically have a bulk density of at least 450 g/litre, more usually at least 600 g/litre and more preferably from 650 g/litre to 1000 g/litre.

Making Processes - Granular Compositions

In general, granular detergent compositions in accordance with the present invention can be made via a variety of methods including dry mixing, spray drying, agglomeration and granulation.

Machine Dishwashing Method

The detergent compositions in accord with the present invention may be used in essentially any conventional machine dishwashing method of the conventional type performed using a dishwasher machine, which may be selected from any of those commonly available on the market.

The machine dishwashing method typically comprises treating soiled articles, such as crockery, glassware, hollowware and cutlery, with an aqueous liquid having dissolved or dispersed therein an effective amount of the detergent composition. By an effective amount of the detergent composition it is generally meant from 8 g to 60 g of detergent composition per wash, dissolved or dispersed in a wash solution volume of from 3 to 10 litres, as are typical product dosages employed in conventional machine dishwashing methods. The wash temperature may be in the range 40° C. to 65° C. as commonly is employed in such processes. A rinse aid composition may also be used, if desired.

Wash Solution

It has been found that calcium carbonate deposits are most likely to be a problem when certain threshold limits of both $Ca^{2+}/Mg^{2+}$ hardness and $CO_3^{2-}/HCO_3^-$ levels are exceeded in the wash/rinse solution. The compositions of the invention are hence most likely to be beneficial when used in wash/rinse solutions in which said threshold limits have been exceeded.

In particular calcium carbonate deposit formation is likely to be a problem when the $CO_3^{2-}/HCO_3^-$ level in the wash/rinse solution exceeds 80 German hardness, and when the $Ca^{2+}/Mg^{2+}$ level in the wash/rinse solution exceeds 6° (3:1 Ca:Mg) German hardness (equivalent to 1.08 mmol $Ca^{2+}$/litre)

EXAMPLES

The following examples illustrate the present invention.

In the following compositions, the abbreviated identifications have the following meanings:

Citrate : Trisodium citrate dihydrate

Phosphate: Sodium tripolyphosphate

Nonionic: $C_{13}$–$C_{15}$ mixed ethoxylated/propoxylated fatty alcohol with an average degree of ethoxylation of 3.8 and an average degree of propoxylation of 4.5 sold under the tradename Plurafac LF404 by BASF Gmbh.

HEDP : Ethane 1-hydroxy-1,1-diphosphonic acid

DETPMP : Diethylene triamine penta (methylene phosphonic acid), marketed by Monsanto under the tradename Dequest 2060

EDDS : Ethylenediamine-N, N'-disuccinic acid

MA/AA: Copolymers of 1:4 maleic/acrylic acid, average molecular weight about 80,000

AA/MA: Random copolymers of acrylic acid and methacrylic acid in a weight ratio of approximately 30:70, with a molecular weight of about 3,500.

Polyacrylate: A polyacrylate homopolymer with an average molecular weight of 8,000 sold under the tradename PA30 by BASF GmbH SCS: Sodium cumene sulfonate Lipase: Lipolytic enzyme sold under the tradename lipolase by Novo Industries A/S Protease: Proteolytic enzyme sold under the trade name Savinase by Novo Industries A/S Amylase: Amylolytic enzyme sold under the trade name Termamyl by Novo Industries A/S
Silicate: Sodium silicate (2.0 ratio)
Metasilicate: Sodium metasilicate
Carbonate: Sodium carbonate
PB4: Sodium perborate tetrahydrate
PB1: Sodium percarbonate monohydrate
PC: Sodium percarbonate coated with a mixed salt of formula $Na_2SO_4.n.Na_2CO_3$ where n is 0.3, and the coating level is 2.5% by weight.
TAED: Tetraacetylethylenediamine AVCl: Chlorine bleach (expressed as available chlorine)
Paraffin: Paraffin oil, sold under the tradename Winog 70 by Wintershall

Example 1

The following granular machine dishwashing detergent composition were prepared.

| | A | B | C | D | E |
|---|---|---|---|---|---|
| Citrate | — | 29.0 | 29.0 | 29.0 | 29.0 |
| Phosphate | 22.0 | — | — | — | — |
| MA/AA | — | 3.7 | 3.7 | — | — |
| Silicate | — | 25.7 | 25.7 | 25.7 | 25.7 |
| Metasilicate | 36.0 | — | — | — | — |
| Carbonate | 7.2 | — | — | — | — |
| PB1 | — | 1.9 | 1.9 | 1.9 | 1.9 |
| PB4 | — | 8.7 | 8.7 | 8.7 | 8.7 |
| TAED | — | 4.4 | 4.4 | 4.4 | 4.4 |
| AVC1 | 0.7 | — | — | — | — |
| Protease | — | 2.2 | 2.2 | 2.2 | 2.2 |
| Amylase | — | 1.5 | 1.5 | 1.5 | 1.5 |
| Benzotriazole | | 0.3 | 0.3 | 0.3 | 0.3 |
| Paraffin | — | 0.5 | 0.5 | 0.5 | 0.5 |
| Nonionic | 0.3 | 1.5 | 1.5 | 1.5 | 1.5 |
| HEDP | — | — | 0.5 | — | 0.5 |
| DETPMP | — | 0.1 | 0.1 | 0.1 | 0.1 |
| Polyacrylate | — | — | — | 3.7 | 3.7 |
| Misc/moisture to balance | | | | | |
| pH (1% solution) | 12.6 | 10.7 | 10.7 | 10.7 | 10.7 |

Compositions A–D are comparative compositions. Composition E is in accord with the invention.

Composition E was made by dry adding each of the component ingredients with the exception of the liquid nonionic surfactant, HEDP, paraffin and benzotriazole components which were mixed together, and then sprayed on to the granular components.

Calcium Carbonate Deposition Evaluation

The tendency to form $CaCO_3$ deposits when used in a machine dishwashing method of each of compositions A to E was assessed using the following test protocol:

A full set of dinnerware (12 dinner plates, 6 side plates, 12 saucers, 6 glasses, 8 tea cups, 16 stainless steel spoons, 4 silver spoons) was placed in a Bosch Siemens SMS 9022 (tradename) automatic dishwasher. 25 g of test detergent composition was placed in the detergent dispenser and 3 g of a rinse aid composition (common to each test) dispensed from the rinse aid dispenser. The 65° C. cycle was selected. Subsequent to each admission of water,of known hardness, to the main cavity of the machine a volume of sodium bicarbonate was added to the prewash water to provide a 30° German hardness level of carbonate ions and 8° German hardness (3:1 ca:Mg) level of $Ca^{2+}/Mg^{2+}$ ions (equivalent to 1.44 mmol $Ca^{2+}$/litre) in the wash (rinse) solution. Subequent to the dispensing of the detergent to the wash solution, 50 g of a representative liquid soil (comprising approximately 1.9% tomato ketchup, 1.9% mustard, 2% egg yolks, 39% milk, 0.6% benzoic acid, 1.9% (dissolved) gravy granules, 3.8% mashed potato, water to balance) was added to the wash solution. This procedure was repeated until 8 complete machine cycles (prewash, wash, two rinses) had been completed. After 8 cycles the machine was stopped and the machine parts and dinnerware were assessed for deposit formation using the following visual scale:

0=no deposits
1=slight deposits
2=significant/heavy deposits

The following results were obtained.

| | Composition | | | | |
|---|---|---|---|---|---|
| Substrate | A | B | C | D | E |
| Glassware | 0 | 1 | 1 | 1 | 0 |
| Chinaware | 0 | 2 | 1 | 1 | 0 |
| Silverware | 0 | 2 | 1 | 1 | 1 |
| Stainless steel | 0 | 2 | 0 | 0 | 0 |
| Machine door | 0 | 2 | 0 | 0 | 0 |
| Machine heater element | 1 | 2 | 1 | 1 | 1 |
| Machine spray arm | 0 | 2 | 2 | 0 | 0 |

The phosphate-containing formulation (composition A) is seen to give rise to only minor deposit formation. Compositions B to E are noted to contain citrate builder. Composition B, which contains no HEDP and only a high molecular weight (80,000) acrylic acid containing polymer gives rise to significant deposits.

Addition of HEDP to composition B (Composition C) is seen to give rise to some improvement in deposit formation prevention. Replacement of the high molecular weight polymer of Composition B, with a low molelular weight (8,000) acrylate polymer (composition D) also provides deposition prevention benefits. Only Composition E, with both HEDP and the low molecular weight (8,000) acrylate polymer, however provides deposition prevention performance comparable to the phosphate reference, in accord with the invention.

Example 2

The following granular compositions in accord with the invention were prepared.

| | F | G | H | I | J |
|---|---|---|---|---|---|
| Citrate | 23.0 | 29.0 | 29.0 | 29.0 | 29.0 |
| Phosphate | — | — | — | — | — |
| Silicate | 25.7 | 25.7 | 25.7 | 25.7 | 25.7 |
| Carbonate | 7.2 | — | — | — | — |
| PB1 | 1.9 | 1.9 | 1.9 | — | — |
| PB4 | 8.7 | 8.7 | 8.7 | — | — |
| Pc | — | — | — | 10.4 | 10.4 |
| TAED | 4.4 | 4.4 | 4.4 | 4.4 | 4.4 |
| Protease | 2.2 | 2.2 | 2.2 | 2.2 | 2.2 |
| Lipase | — | — | 1.5 | — | — |
| Amylase | 1.5 | 1.5 | 1.5 | 1.5 | 1.5 |
| Benzotriazole | 0.3 | 0.3 | 0.3 | 0.3 | 0.3 |
| Paraffin | 0.5 | 0.5 | 0.5 | 0.5 | 0.5 |
| Nonionic | 1.5 | 1.5 | 1.5 | 1.5 | 1.5 |
| HEDP | 0.5 | 0.5 | 0.5 | 0.5 | 0.5 |
| EDDS | — | 0.2 | — | — | — |

-continued

| | F | G | H | I | J |
|---|---|---|---|---|---|
| Polyacrylate | — | 3.7 | 3.7 | — | 3.7 |
| AA/MA | 3.7 | — | — | 3.7 | — |
| Misc/moisture to balance | 10.7 | 10.7 | 10.7 | 10.7 | 10.7 |
| pH (1% solution) | 10.7 | 10.7 | 10.7 | 10.7 | 10.7 |

Example 3

The following tablet formulations in accord with the invention were prepared by a tablet compaction process.

| | K | L | M |
|---|---|---|---|
| Citrate | 23.7 | 23.7 | 23.7 |
| Silicate | 23.8 | 23.8 | 23.8 |
| Carbonate | — | 14.0 | — |
| PB1 | 1.4 | 1.4 | 5.6 |
| PB4 | 6.2 | 6.2 | 6.2 |
| TAED | 3.4 | 3.4 | 3.4 |
| Protease | 1.5 | 1.5 | 1.5 |
| Amylase | 1.1 | 1.1 | 1.1 |
| Paraffin | 0.4 | 0.4 | 0.4 |
| Nonionic | 0.2 | 0.2 | 0.2 |
| Benzotriazole | 0.3 | 0.3 | 0.3 |
| HEDP | 0.6 | 0.6 | 0.6 |
| Polyacrylate | 2.9 | 2.9 | 2.9 |
| DETPMP | 0.4 | 0.4 | 0.4 |
| $Na_2SO_4$ | 33.1 | 19.1 | 28.9 |
| Moisture/misc to balance | | | |

We claim:

1. A detergent composition containing in combination (a) 0.5 to 80% by weight of a detergent builder system containing a carboxylate or polycarboxylate builder containing from one to four carboxy groups, wherein said detergent builder system has a major proportion by weight of non-carbonate builder compound and is free of phosphate-containing builder;

(b) 0.1 to 10% by weight of a non-nitrogen containing organo diphosphonic acid or its salts or complexes or any mixture thereof;

(c) 0.1 to 10% by weight of an organic polymer containing acrylic acid or a salt thereof, having an average molecular weight of less than 15,000, and being selected from the group consisting of (I) homopolymers of acrylic acid and (ii) copolymers of acrylic acid or a salt thereof and a comonomer selected from the group consisting of (1) substituted acrylic acid of the formula $CHR_2{=}CR_1(CO{-}O{-}R_3)$ wherein $R_1$ and $R_2$ are individually $C_1$–$C_4$ alkyl, $C_{1-C4}$ hydroxyalkyl, or hydrogen, and $R_3$ is $C_1$–$C_4$ alkyl, $C_1$–$C_4$ hydroxyalkyl, hydrogen or an alkali metal salt, with at least one of $R_1$, $R_2$ and $R_3$ being $C_1$–$C_4$ alkyl or $C_1$–$C_4$ hydroxyalkyl, (2) fumaric acid, maleic acid, itaconic acid, aconitic acid, mesaconic acid, citraconic acid, methylenemalonic acid, or salts of any of said acids, (3) maleic anhydride, (4) acrylamide, (5) alkylene, (6) vinylmethyl ether, (7) styrene, and (8) mixtures thereof, and (d) a silicate, wherein the detergent composition is in solid form.

2. A detergent composition according to claim 1 wherein said detergent builder system contains less than 30% by weight of the builder system of carbonate builder compound.

3. A detergent composition according to claim 2 wherein said detergent builder system contains no carbonate builder compound.

4. A detergent composition according to claim 1 wherein said carboxylate or polycarboxylate builder is a hydroxycarboxylate containing up to three carboxy groups per molecule.

5. A detergent composition according to claim 4 wherein said hydroxycarboxylate builder is a citrate.

6. A detergent composition according to claim 1 wherein said non-nitrogen containing organo diphosphonic acid is a $C_1$–$C_4$ diphosphonic acid.

7. A detergent composition according to claim 6 wherein said non-nitrogen containing organo diphosphonic acid is ethane-1-hydroxy-1, 1-diphosphonic acid.

8. A detergent composition according to claim 1 wherein said organic polymer has a molecular weight of from 500 to 12,000.

9. A detergent composition according to claim 8 wherein said organic polymer has a molecular weight of from 1500 to 10,000.

10. A detergent composition according to claim 1 wherein said organic polymer is a homopolymer.

11. A detergent composition according to claim 1 wherein said organic polymer is a copolymer containing from 90% to 10% by weight of acrylic acid monomer or its salts and from 10% to 90% by weight of methyl acrylic acid monomer or its salts.

12. A composition according to claim 1 wherein the weight ratio of said organic polymer to said non-nitrogen containing organo diphosphonic acid is from 20:1 to 1:1.

13. A composition according to claim 1 containing from 0.0001% to 2% by weight of active proteolytic enzyme.

14. A composition according to claim 1 containing from 0.0001% to 2% by weight of active lipolytic enzyme.

15. A composition according to claim 1 containing an inorganic perhydrate salt in combination with a peroxyacid bleach precursor.

16. A detergent composition according to claim 1, further containing from 0.5 to 40% by weight of a surfactant.

17. A detergent composition according to claim 1, wherein the detergent composition is in the form of powders, granulates, or tablets.

* * * * *